US006732818B2

(12) United States Patent
Gregory

(10) Patent No.: US 6,732,818 B2
(45) Date of Patent: May 11, 2004

(54) ORIENTED CORE BARREL SYSTEM

(76) Inventor: Frank Gregory, Warren George, Inc. Foot of Jersey Ave., Jersey City, NJ (US) 07303

( * ) Notice: Subject to any disclaimer, the term of this patent is extended or adjusted under 35 U.S.C. 154(b) by 0 days.

(21) Appl. No.: 10/261,496

(22) Filed: Oct. 2, 2002

(65) Prior Publication Data

US 2004/0065478 A1 Apr. 8, 2004

(51) Int. Cl.[7] ..... E21B 49/00; E21B 25/00

(52) U.S. Cl. ..... 175/58; 175/251; 175/44; 175/403

(58) Field of Search ..... 175/403, 44, 244, 175/249, 251, 58

(56) References Cited

U.S. PATENT DOCUMENTS

| | | | | |
|---|---|---|---|---|
| 1,701,724 A | | 2/1929 | MacLaughlin | |
| 1,773,915 A | | 8/1930 | Lydon | |
| 2,120,240 A | * | 6/1938 | Chappell | 175/248 |
| 2,489,566 A | | 11/1949 | Engle | |
| 2,974,739 A | | 3/1961 | Dean | |
| 3,059,707 A | | 10/1962 | Frisby | |
| 3,148,740 A | | 9/1964 | Cauchois | |
| 3,207,239 A | | 9/1965 | Hügel | |
| 4,128,134 A | | 12/1978 | Gregory | |
| 4,558,749 A | | 12/1985 | Fulkerson | |
| 4,883,131 A | * | 11/1989 | Foster | 175/44 |

* cited by examiner

*Primary Examiner*—David Bagnell
*Assistant Examiner*—Daniel P. Stephenson
(74) *Attorney, Agent, or Firm*—Dickstein Shapiro Morin & Oshinsky LLP

(57) ABSTRACT

A device for preserving the orientation of a core is described. A core barrel is attached to a rotatable orienting rod. A plurality of projections are located on an inner surface of the core barrel. Three projections are grouped together and opposite from a fourth projection. A ratchet assembly is included at an end of the rotatable orienting rod opposite from the core barrel. The ratchet assembly includes a first body, to which the rotatable orienting rod is attached, a plate, a second body, and a biasing mechanism. A turning rod is mounted on the plate, which is located between the two bodies. The plate and the second body each have teeth which intermesh, but which slip if a clog in the core barrel inhibits rotation of the rotatable orienting rod.

17 Claims, 5 Drawing Sheets

ORIENTED CORE BARREL SYSTEM

BACKGROUND

It is desirous in obtaining sample cores from bore holes to know the direction that certain parts of the core bear with relation to the surface of the ground where the bore has been made. To accomplish this, complicated mechanisms have heretofore been used. An example is a mechanism including, for instance, a compass and photographic equipment. One disadvantage in such a mechanism is that the drilling operation sends vibrations through the coring equipment and drilling fluid. The vibrations tend to blur the photographs, making it necessary to completely halt the drilling and fluid pumping operations and allow the vibrations to subside, which consumes time, to obtain a clear photograph.

Further, with the use of a compass, the apparatus and the ground material must be non-magnetic so that the compass will not be affected. One such mechanism is shown in U.S. Pat. No. 3,450,216 dated Jun. 17, 1969. It is also known for core taking apparatus to include a core barrel attached to the bottom end of the drill string and isolated from the rotation by bearings. In such an arrangement, friction between the core and core barrel provides the only force holding the core barrel from rotating. Such an apparatus is shown in U.S. Pat. No. 3,004,614. If, however, the core should break, the core barrel will rotate, and all orientation will be lost. In fact, many prior core sampling apparatus rely on the integrity of the core.

It is also known to score the core with internally extending projections, such as, for example, as shown in U.S. Pat. No. 1,701,784. One disadvantage with such projections is that they have been evenly spaced around the core barrel, and thus the orientation of the core may not be accurately ascertained. A further disadvantage is that sometimes the projections fail to adequately score the core.

Another disadvantage of conventional coring device is that such devices are prone to inner rod failure due to clogging at the bottom of the coring device. Conventional coring devices, such as the coring device 100 shown in FIG. 3, are double tube core barrels, with outer tubes 110 and inner tubes 111 mounted on separate bearing assemblies. The inner and outer tubes 110, 111 do not rotate together. Through this arrangement, the amount of water contacting the core is minimized. Blockages sometimes occur during coring operations. A consequence of such blockages is that the inner orienting tubes 111 are prevented from rotating. The continued force of the motor used to rotate the inner orienting tubes 111 eventually leads to the breakage of the tubes 111, thus destroying the orientation of the core.

SUMMARY

The invention provides a device for orienting a core cut in a bore hole. The device includes a plurality of orienting rod sections connected one to another into a rotatable orienting rod, and a core barrel attached to one end of the rotatable orienting rod. The core barrel is configured to receive the core and the core barrel includes a plurality of projections extending from an inward surface of the core barrel. At least three projections are grouped together on the inward surface opposite from a fourth projection.

The invention further provides a system for cutting a core in a bore hole. The system includes a driving means, a plurality of orienting rod sections connected together as an orienting rod, the orienting rod being rotatable by the driving means, a core barrel attached to one end of the orienting rod, and a ratchet assembly for protecting the orienting rod from breakage caused by a clog in said core barrel.

The invention also provides a method for obtaining a cut core from a bore hole. The method includes the steps of extending a rotatable orienting rod, with a core barrel attached thereto, into the bore hole, cutting the core, depositing the core in the core barrel, and scribing the core with a plurality of grouped projections and one opposing projection located on an inner surface of the core barrel.

The foregoing and other advantages and features of the invention will be more readily understood from the following detailed description of the invention, which is provided in connection with the accompanying drawings.

DESCRIPTION OF PREFERRED EMBODIMENTS

Figure 7:
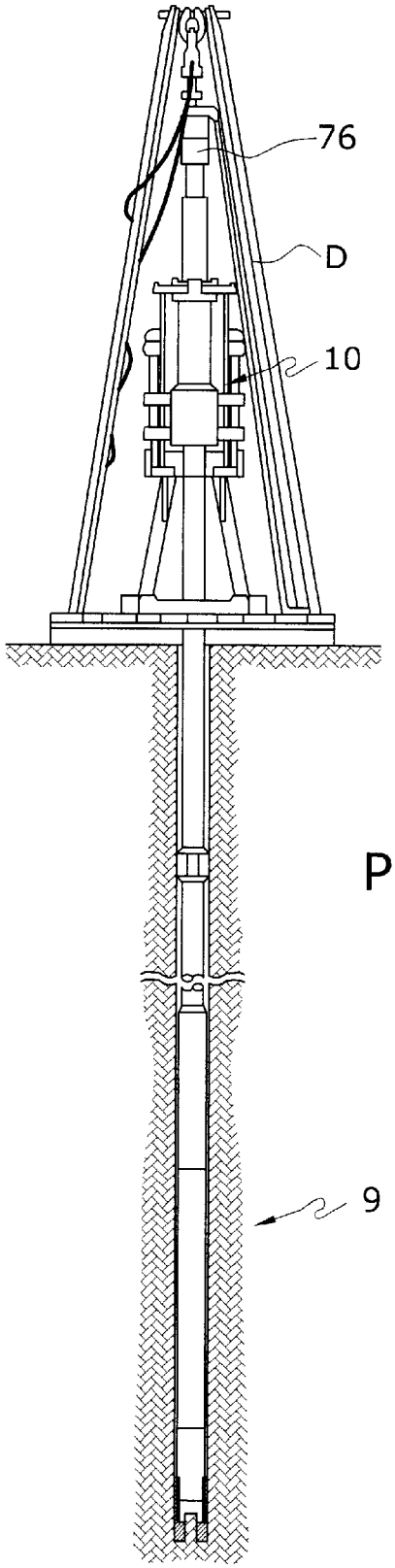
FIG. 7 Prior Art
FIG. 7 is an elevation view partly in cross-section showing the entire coring device in use downhole.

Referring to FIG. 7, a drill pipe assembly 9 formed in several sections and suitably secured together, includes drill rods, outer barrels and an inner core taking means. As shown, the drill rods are rotated by a suitably powered rotary spindle 10. The remainder of the operating rig is completed with a suitable support structure, such as a derrick D, and a source of drilling fluid directed by a drilling fluid swivel 76, together with an engine, a water pump and a drum hoist (not illustrated).

Figure 1:
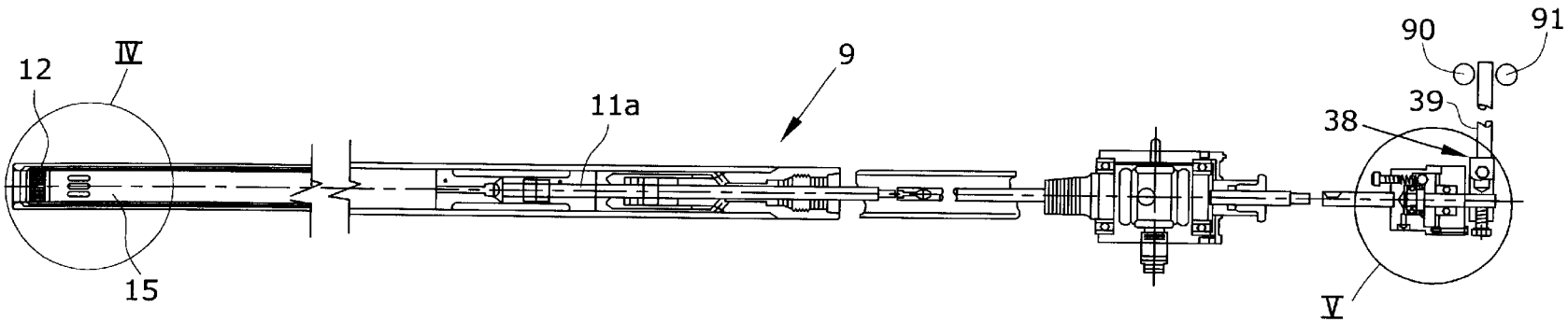
FIG. 1 is a cross-sectional view of a coring device constructed in accordance with an embodiment of the invention.
Figure 2:
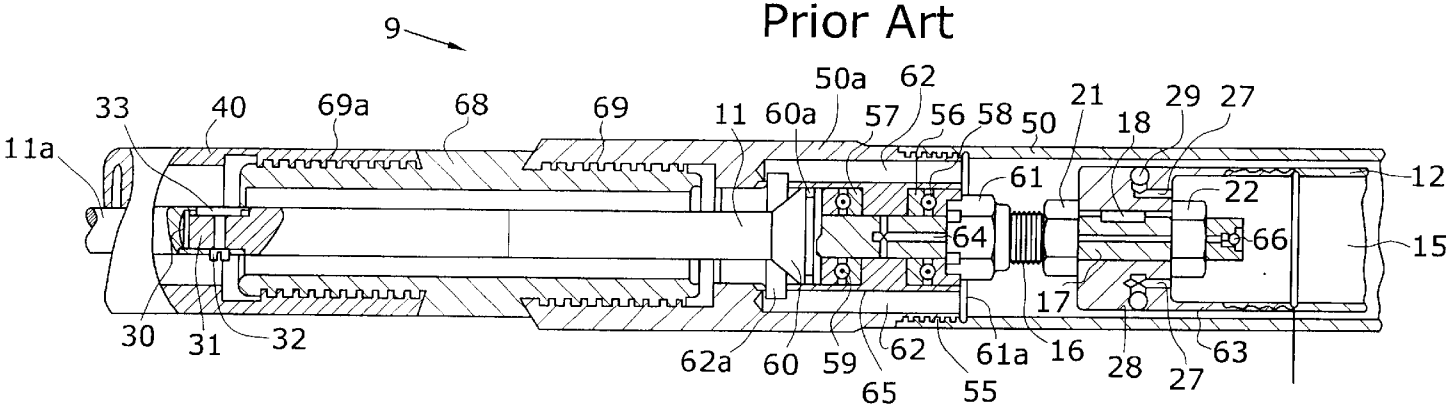
FIG. 2 Prior Art
FIG. 2 is an enlarged cross-sectional view of a portion of the device of FIG. 1.
Figure 3:
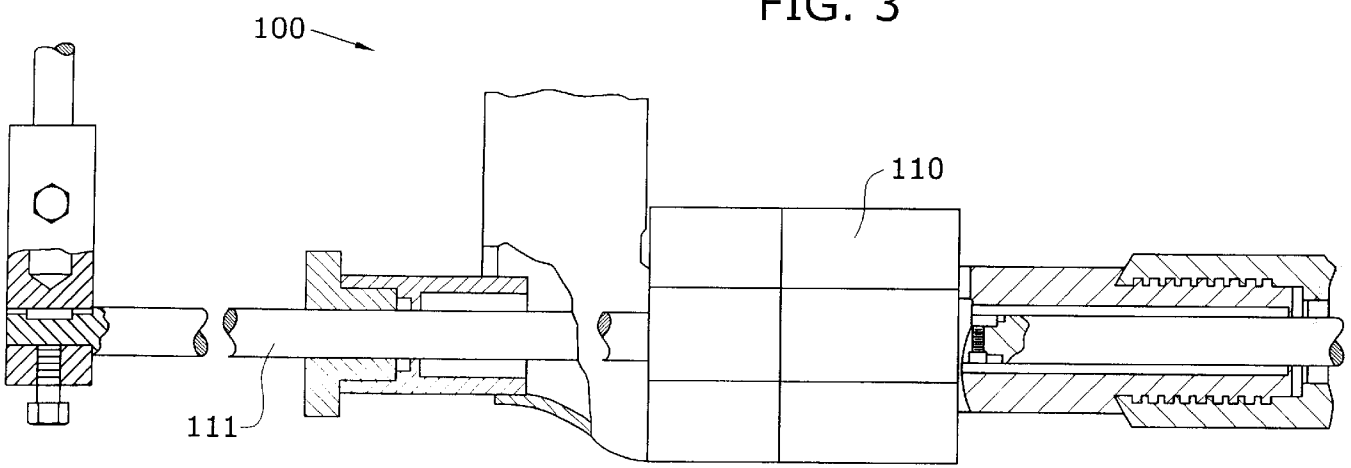
FIG. 3 is an enlarged cross-sectional view of another portion of the coring device of FIG. 1.
Figure 4:
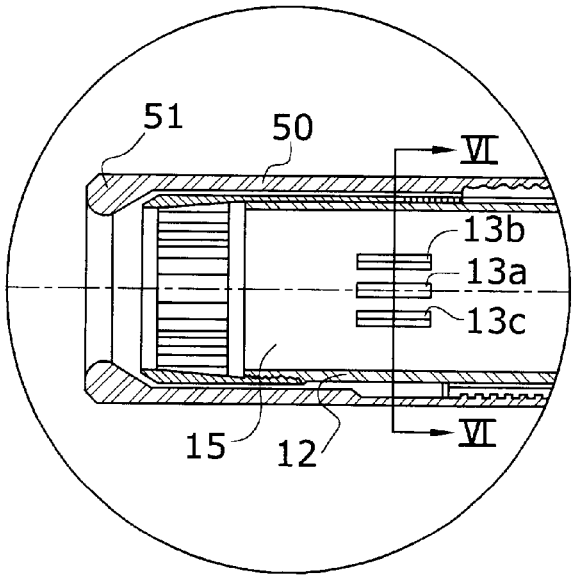
FIG. 4 is an enlarged view of the portion of the device within circle IV of FIG. 1.
Figure 5:
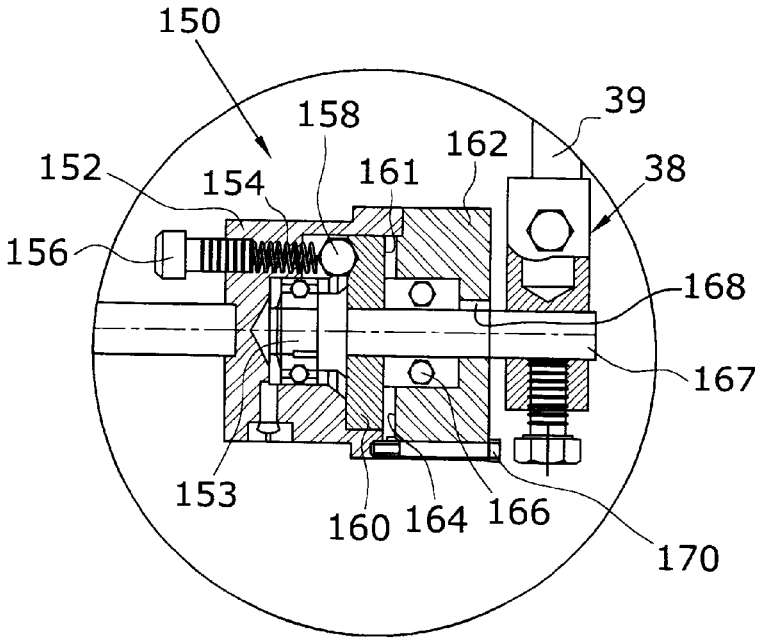
FIG. 5 is an enlarged view of the portion of the device within circle V of FIG. 1.
Figure 6:
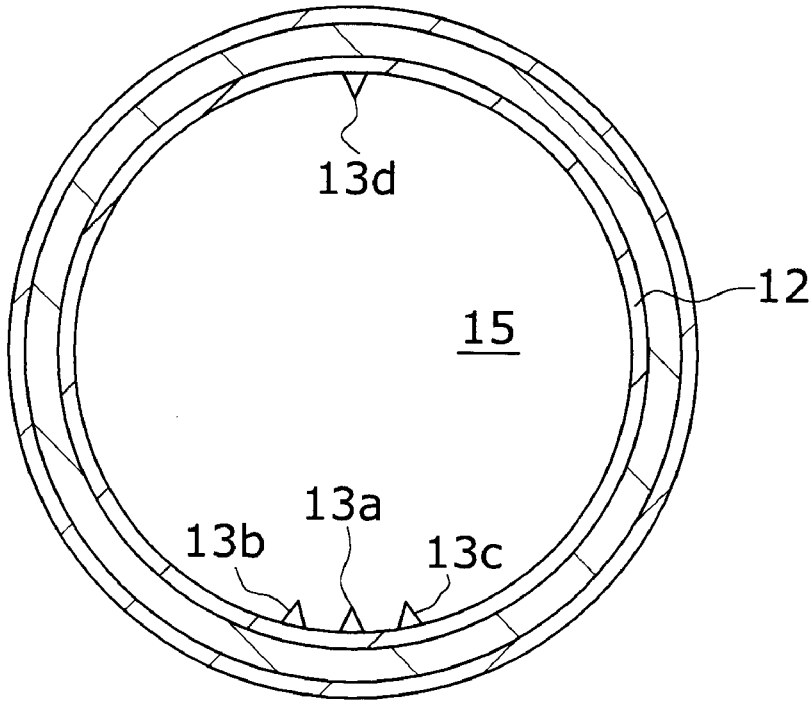
FIG. 6 is a cross-sectional view along line VI—VI of FIG. 4.

With specific reference to FIGS. 1–6, an inner core taking means is shown including a plurality of sections 11*a* (FIGS. 1–3) which are keyed together to form an orienting rod 11. At the working end of the orienting rod 11, a core receiving barrel 12 is rotationally and axially secured (FIGS. 1, 2 and 4). The core receiving barrel 12 carries scribing means 13*a*, 13*b*, 13*c* (FIGS. 4, 6), and 13*d* (FIG. 6) on an inner surface thereof. The scribing means 13*a*–*d* may be projections which are configured to scribe marks in a core section, or the scribing means 13*a*–*d* may be another suitable configuration. As the core is cut and moves into a center area 15 of the core receiving barrel 12, marks or grooves are scribed into the outer surface of the core which are intended to extend generally axially of the core. As shown in FIG. 6, the scribing means 13*a* is opposite (180 degrees) from the scribing means 13*d* and the scribing means 13*b* and 13*c* are grouped together and flank the scribing means 13*a*. Through this arrangement, determining the orientation of a core is rendered more accurate. In practice, scribing means do not always produce scribe marks on cores, and so the presence of three such scribing means 13*a*–*c* on one side and another scribing means 13*d* on an opposing side of the core receiving barrel 12 allows one examining the core to piece together partial scribe marks from all of the scribing means 13*a–d* to ascertain the proper orientation of the core.

The core receiving barrel 12 has a generally closed upper end and through this end there is an axially drilled, keyed bore 17. The lower end of the orienting rod 11 as shown in FIG. 2 is threaded, and this threaded portion 16 passes through the bore 17 with a key 18 securing the core receiving barrel 12 against rotation. A pair of nuts 21 and 22 secure the barrel 12 in an axially adjustable position. The head of the core barrel 12 is provided with a plurality of small conduits 27 that extend upwardly and radially outwardly into a groove 28 which is closed by means of an O-ring 29. Thus, if any drilling fluid is trapped in the core barrel 12, it may pass by virtue of its pressure through these conduits 27 and 28, and out past the O-ring 29.

As has been mentioned, the orienting rod 11 is made up of a plurality of sections 11*a* as necessary. For example, a first rod section 11*a* is keyed to a second rod section 11*a* by providing a socket 30 which receives a reduced end 31 of the second rod section 11*a*, which is held in position by a holding screw 32 and keyed by a key 33.

Surrounding the orienting rod 11 is a drill rod designated 40 which is illustrated as composed of several sections, each threadingly coupled together throughout the length as necessary. At one end of the drill rod section 40, there is threadingly secured thereto an outer barrel head 50*a* and an outer barrel 50. At an end of the outer barrel 50 are cutting blades 51 (FIG. 4). The outer barrel 50 rotates, which allows the cutting blades 51 to cut the core which is received in the non-rotating core barrel 12.

The outer barrel head 50*a* is provided with threads 55 that threadingly engage the outer barrel 50. The outer barrel head 50*a* is provided with a central bore therethrough, and the central bore is counter-bored at counter-bore areas 56 and 57. The counter-bore areas 56, 57 receive, respectively, bearing units 58 and 59. The orienting rod 11 is rotationally supported by these bearings 58 and 59 and is provided with means for stabilizing its axial position with an enlarged boss 60 having a seal 60*a* and a nut 61. The nut 61 also has a seal 61*a* and is threadingly received on the threaded portions 16 of the orienting rod section 11*a*. In addition, the outer barrel head 50*a* includes means for allowing drilling fluid to pass therethrough and is provided with a plurality of axially extending bores 62 that connect via a groove 62*a* to the open central portion of the drill rod assembly 9. Lubrication of the bearings is readily provided by means of an axially extending bore 64 and a lateral passageway 65 which is fed through a grease fitting 66 in a fashion well known to those skilled in the art.

The outer barrel head 50*a* is coupled to a portion of the drill rod section 40 by means of a connector 68 which has threads 69 and 69*a* at either end thereof for engaging corresponding threads in the drill rod section 40 and the outer barrel head 50*a*. The connector 68 is provided with a central bore therethrough which allows the passage of the orienting rod 11 as well as sufficient area for the passage of drilling fluid through the drill rod section 40 as will be explained in greater detail below. Each additional drill rod section 40 needed to provide the proper length may be coupled onto the drill rod section 40 and to each other by means of the same connector 68, or by a different connector, as required.

In use, a driving means, namely the rotary spindle 10 (FIG. 7) at the upper end of the drill pipe assembly 9, rotates the drill pipe assembly 9 as it is passed downhole into the ground to cut a core which passes into the center area 15 (FIGS. 1, 2). The core is scribed by the scribing means 13*a–d*, one of which is oriented with a pointing device 38 having an arm 39 (FIGS. 1, 5). The pointing device 38 may be oriented in such a fashion that it will point to some certain predetermined position either fixed on the ground or to a certain compass bearing, such as to north or the like. For example, a pair of vertical posts 90, 91 (FIG. 1) driven in the ground may maintain alignment. Thus, the core will be marked by reason of the alignment with one of the scribing means 13*a–d* which may be differentiated from the other scribing means 13*a*–13*d* so that it may be known how the core lines up with a certain location above ground. The arm 39 may extend outwardly between, for example, the vertical posts 90, 91 so that it will maintain its position unless manually changed to orient the device in a different position. It should be appreciated that the device may be started at any point of orientation which is desirable. Further, if desired, the pointing device 38 and arm 39 may simply be left free and unrestrained with notations made of its compass bearing at various intervals during the coring operation. From the above, it will be apparent that the position of the scribes as received on the core is unaffected by interruptions in the coring operation or by breaks, seams, voids or any other faults that may exist in the material being cored.

With specific reference to FIG. 5, next will be described a ratchet assembly useful to suppress the breaking of the orienting rod 11 when a blockage is encountered at the working end of the drilling rod assembly 9. As shown, a ratchet assembly 150 includes a first body 152 and a second body 162. The first and second bodies 152, 162 are retained to one another with a retaining pin 170. The orienting rod 11 extends into the first body 152. A turning rod 167, which is rotated by the rotary spindle 10, extends through the pointing device 38 through an opening 168 in the second body 162. As will be described in greater detail below, the turning rod 167 rotates the first and second bodies 152, 162 and thereby rotates the orienting rod 11.

The first body 152 is cup-shaped having an open area 153. A plate 160 is positioned within the open area 153. The turning rod 167 extends through and is mounted to the plate 160. The plate 160 includes a plurality of teeth 161. The second body 162 also has a plurality of teeth 164 which mesh with the teeth 161 of the plate 160. An O-ring 166 encircles the turning rod 167 within a cavity of the second body 162.

A biasing mechanism is positioned in the first body 152. Specifically, as shown in FIG. 5, a spring 154 is positioned within the open area 153 and extends toward the plate 160. At one end of the spring 154 is a sphere 158 which contacts the plate 160. At the other end of the spring 154 is a spring biasing member 156. The spring biasing member 156 is tightened down to put a certain amount of force on the plate 160 such that the teeth 161 mesh with the teeth 164 during normal use but slip against each other when a clog at the working end of the drilling rod assembly 9 causes torsional forces on the orienting rod 11. The rotary spindle 10 (FIG. 7) rotates the turning rod 167, which in turn rotates the plate 160. Under normal loading, the teeth 161 of the plate 160 mesh with the teeth 164 of the second body 162, thereby causing rotation of the first and second bodies 152, 162 and the orienting rod 11. When torsional forces act upon the orienting rod 11, the orienting rod 11 ceases to rotate or rotates at a lower rotational speed than the turning rod 167. Prior to the inclusion of the ratchet assembly, these torsional forces would act severely enough on the drilling rod assembly 9 to shear the orienting rod 11, thus destroying the ability to ascertain the true orientation of a cut core sample. With the ratchet assembly, the torsional forces act on the plate 160, causing the plate teeth 161 to slip relative to the teeth 164 of the second body 162. This allows for a differential in the turning speeds of the orienting rod 11 and the turning rod 167, thus suppressing the breakage of the orienting rod 11.

While the foregoing has described in detail preferred embodiments known at the time, it should be readily understood that the invention is not limited to the disclosed embodiments. The invention can be modified to incorporate any number of variations, alterations, substitutions or equivalent arrangements not heretofore described, but which are commensurate with the spirit and scope of the invention. For example, while three scribing means 13*a–c* are shown and described, it should be appreciated that two or more than three such scribing means can be grouped closely together on one side and opposite from another such scribing means within a core taking apparatus. Accordingly, the is not limited to the embodiment specifically described but is only limited by the scope of the appended claims.

What is claimed as new and desired to be protected by Letters Patent of the United States is:

1. A device for orienting a core cut in a bore hole, comprising:

a plurality of orienting rod sections connected one to another into a rotatable orienting rod; and a core barrel attached to one end of the rotatable orienting rod, said core barrel configured to receive the core and said core barrel comprising a plurality of projections extending from an inward surface of said core barrel and adapted for marking the core, wherein at least three said projections are grouped together on the inward surface opposite from a fourth said projection.

2. The device of claim 1, wherein said plurality of projections comprise a first projection flanked on one side by a second projection and on the other side by a third projection and opposite a fourth projection.

3. The device of claim 2, wherein said first, second, third and fourth projections are configured to scribe marks into the core to allow an orientation of the core to be determined.

4. The device of claim 1, further comprising a ratchet assembly for protecting said rotatable orienting rod from breakage caused by a clog in said core barrel.

5. The device of claim 4, wherein said ratchet assembly comprises:

a first body connected to said rotatable orienting rod and having an open area;

a second body attached to said first body and having a plurality of teeth; and a turning rod extending through said second body into said open area.

6. The device of claim 5, wherein said ratchet assembly further comprises:

a plate having a plurality of teeth configured to mesh with said teeth of said second body, said turning rod extending through and being mounted to said plate; and a biasing mechanism configured to bias said plate toward said second body with a predetermined biasing force.

7. The device of claim 6, wherein said biasing mechanism comprises a spring and a spring biasing member.

8. The device of claim 5, further comprising a pointing device having an arm and being connected to said turning rod.

9. A system for cutting a core in a bore hole, comprising:

a driving means;

a plurality of orienting rod sections connected together as an orienting rod, said orienting rod being rotatable by said driving means;

a core barrel attached to one end of said orienting rod; and a ratchet assembly for protecting said orienting rod from breakage caused by a clog in said core barrel, wherein said ratchet assembly comprises:

a first body connected to said rotatable orienting rod and having an open area;

a second body attached to said first body and having a plurality of teeth;

a turning rod extending through said second body into said open area;

a plate having a plurality of teeth configured to mesh with said teeth of said second body, said turning rod extending through and being mounted to said plate; and a biasing mechanism configured to bias said plate toward said second body with a predetermined biasing force.

10. The system of claim 9, wherein said biasing mechanism comprises a spring and a spring biasing member.

11. A system for cutting a core in a bore holes comprising:

a driving means;

a plurality of orienting rod sections connected together as an orienting rod, said orienting rod being rotatable by said driving means;

a core barrel attached to one end of said orienting rod; and a ratchet assembly for protecting said orienting rod from breakage caused by a clog in said core barrel;

wherein said core barrel comprises a plurality of projections extending from an inward surface of said core barrel, said projections being configured to scribe marks into the core for orienting the core, wherein said plurality of projections comprises a first set of projections grouped on one side of said inward surface of said core barrel and an opposing projection positioned opposite said first set of projections, and wherein said first set of projections comprises a first projection flanked on one side by a second projection and on the other side by a third projection.

12. The system of claim 11, wherein said opposing projection is positioned opposite said first projection.

13. A method for obtaining a cut core from a bore hole, comprising:

extending a rotatable orienting rod, with a core barrel attached thereto, into the bore hole;

cutting the core;

depositing the core in the core barrel; and scribing the core with three grouped projections and one opposing projection located on an inner surface of the core barrel.

14. The method of claim 13, wherein said the opposing projection is opposite from the middle of the three grouped projections.

15. The method of claim 13, further comprising protecting the rotatable orienting rod from breakage due to a clog in the core barrel.

16. The method of claim 15, wherein said protecting comprises connecting a ratchet assembly to the rotatable orienting rod, said ratchet assembly configured to inhibit rotation of the rotatable orienting rod upon the presence of a clog in the core barrel.

17. The method of claim 16, wherein said connecting comprises:

connecting a first body, having an open area, to the rotatable orienting rod;

positioning a plate, having a plurality of teeth, in the open area;

attaching a second body, having a plurality of teeth, to the first body; and mounting a turning rod on the plate, wherein the plate plurality of teeth slip relative to the second body plurality of teeth upon the presence of a clog in the core barrel.

* * * * *